US010028073B2

(12) United States Patent
Matsunaga et al.

(10) Patent No.: US 10,028,073 B2
(45) Date of Patent: Jul. 17, 2018

(54) EFFECT GIVING DEVICE

(71) Applicant: Kawai Musical Instruments Manufacturing Co., Ltd., Hamamatsu-shi, Shizuoka (JP)

(72) Inventors: Kaoru Matsunaga, Shizuoka (JP); Ikuya Kato, Shizuoka (JP)

(73) Assignee: Kawai Musical Instruments Manufacturing Co., Ltd., Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/305,418

(22) PCT Filed: Oct. 5, 2015

(86) PCT No.: PCT/JP2015/078155

§ 371 (c)(1),
(2) Date: Oct. 20, 2016

(87) PCT Pub. No.: WO2016/063712

PCT Pub. Date: Apr. 28, 2016

(65) Prior Publication Data

US 2017/0048642 A1 Feb. 16, 2017

(30) Foreign Application Priority Data

Oct. 24, 2014 (JP) ..... 2014-217442

(51) Int. Cl.
*H04S 7/00* (2006.01)
*H04R 29/00* (2006.01)

(52) U.S. Cl.
CPC ..... *H04S 7/307* (2013.01); *H04S 7/308* (2013.01); *H04R 29/001* (2013.01); (Continued)

(58) Field of Classification Search
None
See application file for complete search history.

(56) References Cited

U.S. PATENT DOCUMENTS 5,939,656 A * 8/1999 Suda ..... G10H 1/0091 381/63
2001/0049995 A1 12/2001 Torii et al.
(Continued)

FOREIGN PATENT DOCUMENTS

JP 11-161266 A 6/1999
JP 2002-108338 A 4/2002
JP 2010-193105 A 9/2010

OTHER PUBLICATIONS

International Search Report of PCT/JP2015/078155 dated Nov. 2, 2015.

*Primary Examiner* — Curtis Kuntz
*Assistant Examiner* — Qin Zhu
(74) *Attorney, Agent, or Firm* — Sughrue Mion, PLLC

(57) ABSTRACT

An effect giving device that can solve a problem that sound is localized inside a head when using a headphone and a problem that timbre changes depending on kind of the headphone is provided. A DSP 10 performs a speaker adjusting equalizer process that processes an entire bandwidth with seven bands. When output selecting means select a headphone 320, the DSP 10 performs a headphone adjusting equalizer process of the entire bandwidth with three bands of the equalizer process, and processes a process of other bands by replacing it to a lateralization sense alleviating process for the headphone 320. Since the headphone 320 and a speaker 318 are exclusively used, using an identical program storage area efficiently ensures an alleviation of a lateralization sense when using the headphone 320 and an adjustment of the timbre.

8 Claims, 7 Drawing Sheets

(52) U.S. Cl.
CPC ..... *H04S 2400/09* (2013.01); *H04S 2420/01* (2013.01); *H04S 2420/07* (2013.01)

(56) References Cited

U.S. PATENT DOCUMENTS

2005/0286725 A1* 12/2005 Yamada ..... H04S 5/00 381/17
2006/0083394 A1* 4/2006 McGrath ..... H04S 3/00 381/309
2006/0140418 A1* 6/2006 Koh ..... H04R 25/70 381/98
2014/0037107 A1* 2/2014 Marino, Jr. ..... H03G 3/10 381/107
2014/0153727 A1* 6/2014 Walsh ..... H04S 7/306 381/58
2014/0369519 A1* 12/2014 Leschka ..... H03G 5/165 381/74
2014/0376754 A1* 12/2014 Banerjea ..... H04S 3/004 381/311
2015/0172803 A1* 6/2015 Kelloniemi ..... H04R 1/1041 381/74

* cited by examiner

EFFECT GIVING DEVICE

CROSS REFERENCE TO RELATED APPLICATIONS

This application is a National Stage of International Application No. PCT/JP2015/078155 filed Oct. 5, 2015, claiming priority based on Japanese Patent Application No. 2014-217442, filed Oct. 24, 2014, the contents of which are incorporated herein by reference in their entirety.

TECHNICAL FIELD

The present invention relates to an effect giving device.

BACKGROUND ART

An electronic instrument such as an electronic piano is influenced by, for example, a case at its mount part when music sound is output from a speaker. Accordingly, for each product, a speaker adjusting equalizer (EQ), which is consist of a digital signal processor (DSP) and the like, divides the music sound into a plurality of bands to change frequency characteristics of each music sound. Thus, the speaker adjusting equalizer (EQ) can accentuate and conversely reduce a specific frequency bandwidth (harmonic components, higher harmonics components, or noise components) of each music sound to correct (averaging) and improve (for example, clarification of a sound image) an entire sound quality for outputting natural music sound.

Therefore, as illustrated in FIG. 6, the equalizer consist of the DSP, requires relatively a wide area as a program area in the DSP for realizing this. The natural music sound will be output from the speaker through the speaker adjusting equalizer (EQ), which is realized in the DSP by this program.

On the other hand, a headphone is mostly used when playing the electronic piano and the like at home. In a case of the headphone, unlike the above-described speaker, it is not necessary to consider influence of the mounted part. Accordingly, as illustrated in FIG. 7, the music sound is adjusted to be output to a side of the headphone without pass through a part of the speaker adjusting equalizer (EQ).

SUMMARY OF INVENTION

Technical Problem

However, when playing the above-described music sound on the headphone, the sound is lateralized in the head, and timbre (the frequency characteristic) changes according to a kind of the headphone. These improvements are required.

The present invention, which is invented in consideration of such actual condition, provides a configuration of an effect giving device that can solve the problem that the sound is localized inside the head when using the headphone and the problem that the timbre (the frequency characteristic) changes according to the kind of the headphone.

Solution to Problem

The configuration of the present invention is an effect giving device using a programmable processor including:

signal processing means configured to give an effect to an input music sound signal, outputting means configured to output the signal where the signal processing means have given the effect, to any of a plurality of devices at least including a headphone, and output selecting means configured to select to output to any of the outputting means, and the configuration of the present invention has a basic feature that the signal processing means perform a characteristic changing process that processes an entire bandwidth with N bands, and when the headphone is selected by the output selecting means, the signal processing means perform the characteristic changing process of the entire bandwidth with M bands (M<N) of the characteristic changing process, and process the characteristic changing process of other band by replacing to a headphone sound field controlling process.

According to the configuration, the signal processing means perform the characteristic changing process that processes the entire bandwidth with N bands, and when the headphone is selected by the output selecting means, the signal processing means perform the characteristic changing process of the entire bandwidth with M bands (M<N) of the characteristic changing process, and process the characteristic changing process of other band by replacing to the headphone sound field controlling process. Accordingly, the headphone and other output means are exclusively used to ensure efficiently alleviation of a lateralization sense when using the headphone and adjustment of the timbre by using an identical program storage area.

As the characteristic changing process, an equalizer process is performed to solve the problem that the timbre (the frequency characteristic) changes according to the kind of the headphone.

As the headphone sound field controlling process, a lateralization sense alleviating process is performed to alleviate the lateralization sense when using the headphone.

Furthermore, the lateralization sense alleviating process may perform a process that alleviates the lateralization sense of the headphone by using a head-related transfer function, and may perform a reverb process.

Advantageous Effects of Invention

According to the configuration of the present invention, the signal processing means perform the characteristic changing process that processes the entire bandwidth with N bands, and when the headphone is selected by the output selecting means, the signal processing means perform the characteristic changing process of the entire bandwidth with M bands (M<N) of the characteristic changing process, and process the characteristic changing process of other band by replacing to the headphone sound field controlling process. Accordingly, the headphone and other output means are exclusively used to be able to provide an excellent effect that ensures efficiently alleviation of the lateralization sense when using the headphone and adjustment of the timbre by using the identical program storage area.

BRIEF DESCRIPTION OF DRAWINGS

FIG. 4 is a flowchart illustrating an entire process flow performed when the electronic piano is powered on.

DESCRIPTION OF EMBODIMENTS

The following describes an embodiment of the present invention with exemplary drawings.

Embodiment 1

Figure 1:
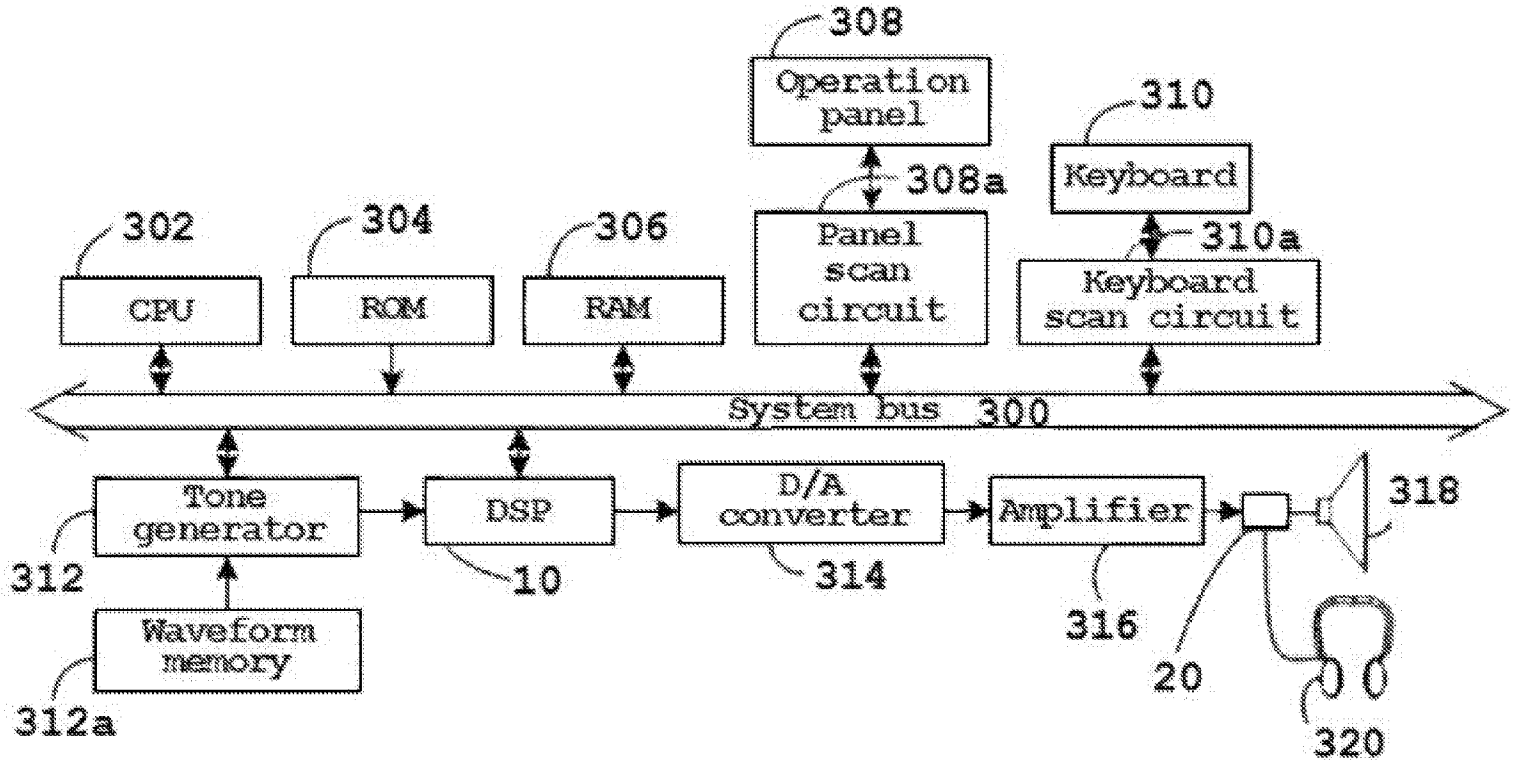
FIG. 1 is a block diagram illustrating a schematic configuration of an electronic piano where an effect giving device according to one embodiment of the present invention is used.

FIG. 1 is a block diagram illustrating a schematic configuration of an electronic piano where an effect giving device of the present invention is used.

As illustrated in this drawing, a CPU 302, a ROM 304, a RAM 306, an operation panel 308 via a panel scan circuit 308*a*, a keyboard 310 via a keyboard scan circuit 310*a*, a tone generator 312, and a DSP 10 are coupled to a system bus 300. Input/output of command data to/from the respective units, and timing control of their input/output are performed. That is, the system bus 300 controls the respective circuits coupled to it by the CPU 302, which is described later, to cause them to function as an electronic piano.

The ROM 304 stores a program memory (not illustrated) that stores a program used at the CPU 302 and DSP 10, which are described later, and various necessary data (for example, an coefficient used at the DSP 10).

The RAM 306 temporarily stores various parameters, data, and the like, which are generated in control by the CPU 302.

The operation panel 308, the keyboard 310, and the like are disposed at the electronic piano. A timbre switch that selects timbre of music sound to be generated, a switch for an effect setting such as delay, and the like are disposed at the operation panel 308. A setting value of information set from this operation panel 308 is detected by a scan of the panel scan circuit 308*a*, and then the information is supplied to the CPU 302 via the system bus 300.

The keyboard 310 is constituted of a keyboard with 88 keys. Keyboard sensors (not illustrated), which are constituted of touch sensors, are each disposed at the respective keys. The keyboard sensor detects a performance operation with respect to the keyboard 310 of a player to output various performance information as key depression information (including information such as key depression timing (key on) and key separation timing (key off)). Such data is detected at the keyboard scan circuit 310*a*. A key-map KMP is created from the data. The data is supplied to the CPU 302 via the system bus 300, and then transmitted to the tone generator 312 by the CPU 302. Then, the tone generator 312 generates music sound data by reading waveform data from a waveform memory 312*a*.

The CPU 302 performs the program read from the ROM 304 to manage control of the above-described respective units and a data input/output process to control entirely the above-described respective circuits, which are coupled by the above-described system bus 300, as the electronic piano, and give a control instruction to the tone generator 312. Additionally, the program using the DSP 10 for a process of this effect giving device, and necessary coefficient data are read from the ROM 304 to be transmitted to the DSP 10. This adds necessary acoustic effect to the above-described music sound data output from the tone generator 312, while controlling an external memory (not illustrated).

At the time, the electronic piano where this effect giving device is implemented is influenced by a case of its mount part, and the like when the music sound is output from the speaker 318, which is described later, mounted to the electronic piano. Accordingly, for each product lineup, a speaker adjusting equalizer (EQ), which is consist of a part of functions of the DSP 10, divides the music sound into seven bandwidths at the configuration of the embodiment to change frequency characteristics of each music sound. Thus, the speaker adjusting equalizer (EQ) accentuates and conversely reduces a specific frequency bandwidth (harmonic components, higher harmonics components, or noise components) of each music sound to correct and improve (for example, clarification of a sound image) an entire sound quality for outputting natural music sound from the above-described speaker 318.

The music sound data where the acoustic effect output from the DSP 10 has been given is input to a D/A converter 314 to be transformed to an analog signal. The analog signal is amplified at an amplifier 316 to be output from the speaker 318 or a headphone 320 corresponding to outputting means of this application.

Usually, the music sound is output by using the speaker 318. However, there is a jack of a headphone plug (a headphone jack; 20 in the drawing) at a part of the case, and if a plug of the headphone 320 is inserted there, the music sound is output from the headphone 320 and is not output from the speaker 318 (if the above-described plug is removed, the output returns).

In response to inserting and removing the plug into/from the above-described headphone jack 20, the output from the speaker 318 or the output from the headphone 320 is selected. Output selecting means in this application is consist of this headphone jack 20 and the CPU 302 that detects its state. This output selecting means select the output from the speaker 318 or the output from the headphone 320. In the configuration of the embodiment, a signal process by later signal processing means differs depending on the output from any of them.

Further, in the configuration of the embodiment, depending on if an output side selected corresponding to a state of the above-described headphone jack 20 is the speaker 318 or the headphone 320, it is determined that the DSP 10, which constitutes the signal processing means of this application, performs a characteristic changing process of an entire bandwidth with seven bands (an equalizer process in the embodiment), or the DSP 10 performs the characteristic changing process of the entire bandwidth with three bands of the seven bands (in the embodiment, the equalizer process of the three bands of the above-described seven bands is left) and processes the characteristic changing process of the four bands by replacing to a headphone sound field controlling process.

Speaking in line with an actual process of the configuration of the embodiment, the signal processing means consist of the DSP 10 cause all the seven bands to perform a speaker adjusting equalizer process as a process of the above-described DSP 10 for outputting when the output side selected corresponding to the state of the above-described headphone jack 20 is the speaker 318, and causes a part of the above-described bands to perform a headphone adjusting equalizer process as the above-described process for outputting (as described above, in the embodiment, the equalizer process of the three bands of the above-described seven bands is left) and a lateralization sense alleviating process by using a remaining program storage area of the above-described bands when the selected output side is the headphone 320.

The above-described signal processing means are basically consist of the DSP 10. Other than this configuration, the signal processing means are consist of the CPU 302, which performs the program of this electronic piano read from the above-described ROM 304, and the ROM 304, which stores speaker adjusting equalizer process programs, headphone adjusting equalizer process programs (in practice, the remaining three adjusting equalizer process programs of the above-described speaker adjusting equalizer process programs), and lateralization sense alleviating process programs, which are read by an instruction of the above-described CPU 302, stored in the program storage area in the DSP 10, and performed by an arithmetic processing of the DSP 10.

As described above, when the music sound is output from the speaker 318 mounted to the electronic piano, the electronic piano is influenced by a case of its mount part and the like. Accordingly, for each product, the speaker adjusting equalizer (EQ) consist of the DSP 10 divides the music sound into the seven bandwidths (in the case of the embodiment) to change frequency characteristics of each music sound. Thus, the speaker adjusting equalizer (EQ) can accentuate and conversely reduce a specific frequency bandwidth (harmonic components, higher harmonics components, or noise components) of each music sound to correct (averaging) and improve (for example, clarification of a sound image) an entire sound quality for outputting natural music sound.

Figure 2:
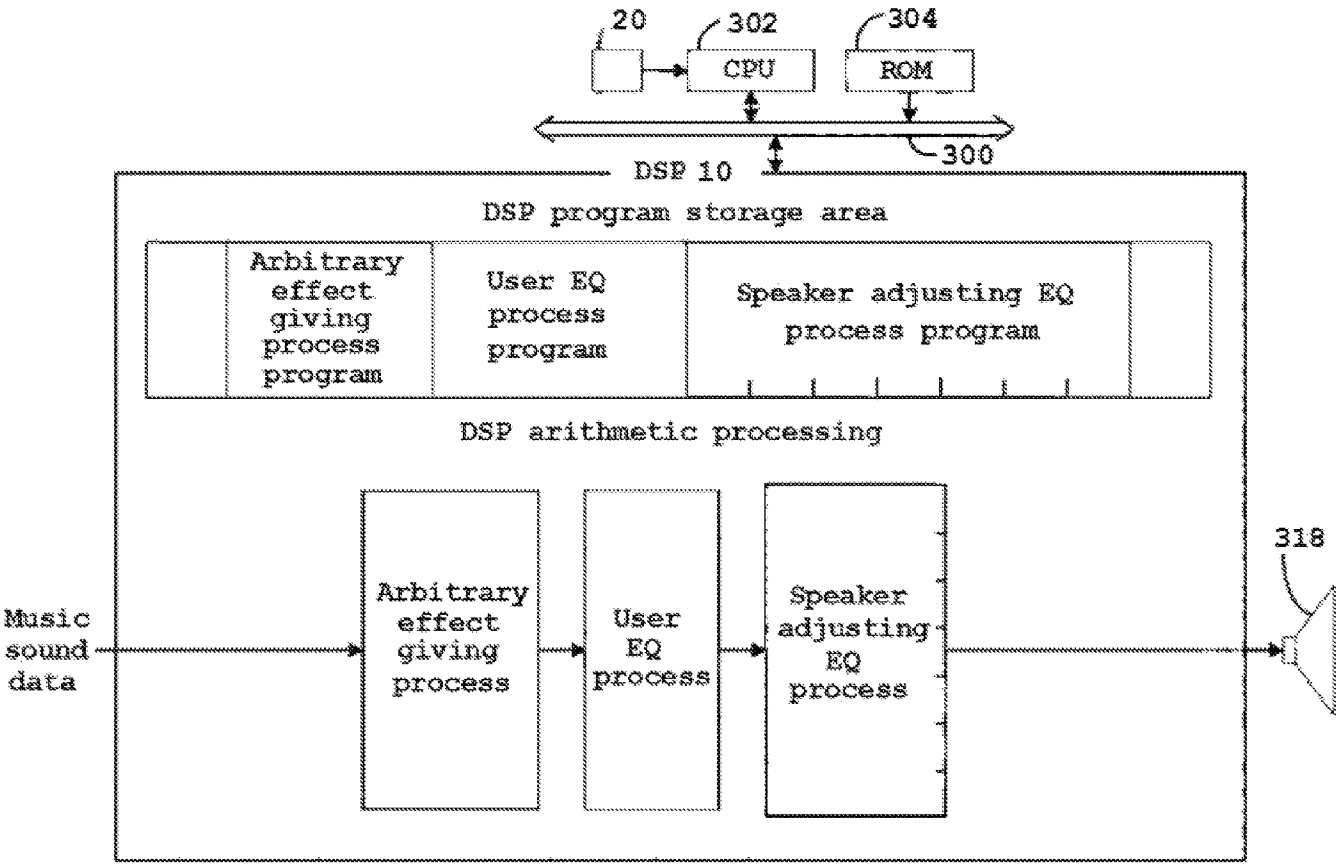
FIG. 2 is a schematic diagram illustrating a state where a speaker adjusting equalizer is disposed in a DSP 10, according to the configuration of the embodiment.

Therefore, the equalizer consist of the DSP 10, as illustrated in FIG. 2, requires as a program area in the DSP 10 for realizing this, a wide area corresponding to it. The natural music sound will be output from the speaker through the speaker adjusting equalizer (EQ), which is realized in the DSP 10 by the program.

This speaker adjusting equalizer process program, which is also stored in the ROM 304 from the beginning, is read by the instruction of the CPU 302, stored in the program storage area at a side of the DSP 10, and performed by the arithmetic processing of the DSP 10 to function as the speaker adjusting equalizer when the speaker 318 is selected as the output side corresponding to the state of the headphone jack 20.

Figure 3:
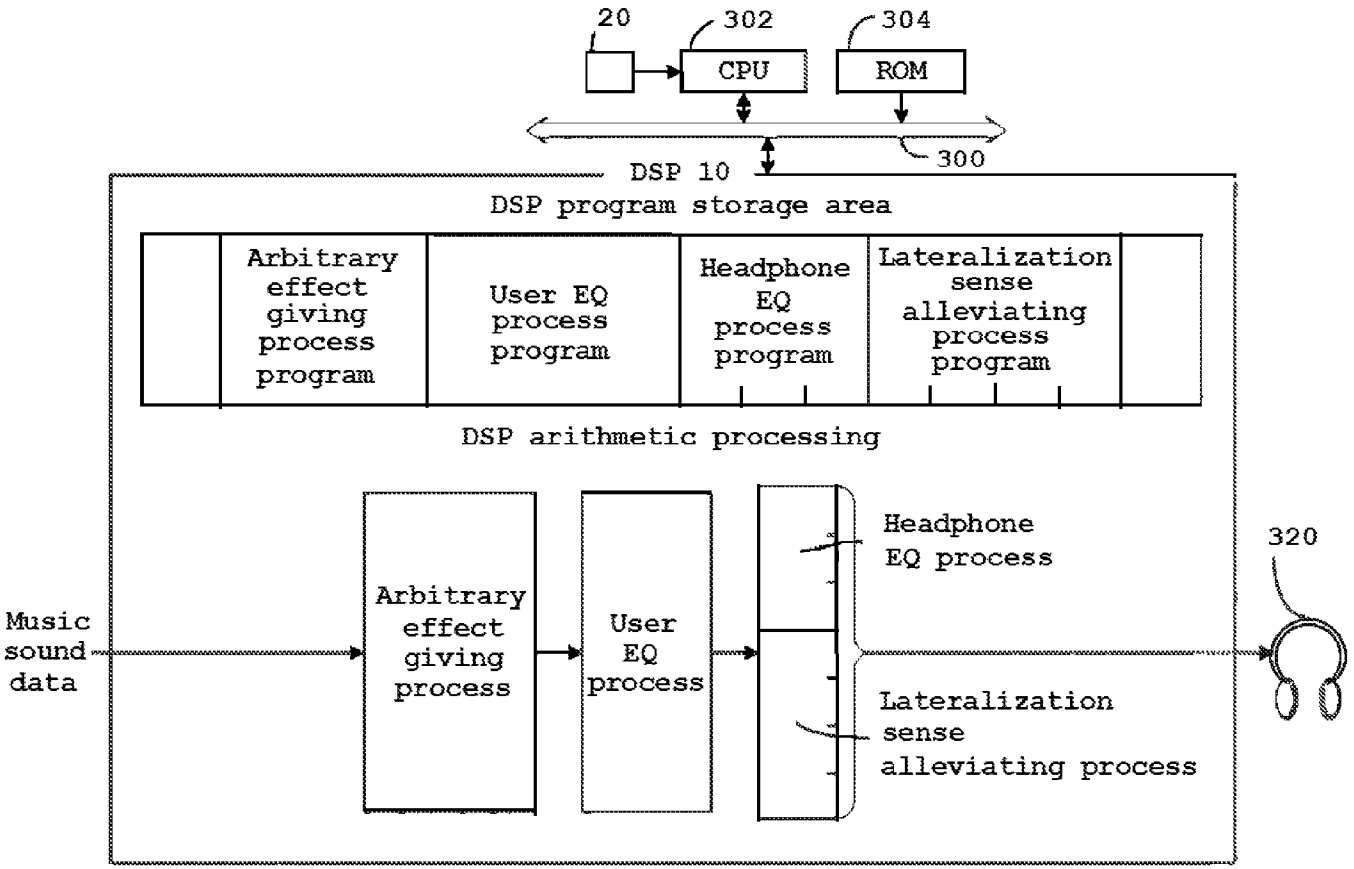
FIG. 3 is a schematic diagram illustrating a state where only three of seven bandwidths are assigned to an equalizer process of a headphone 320, and remaining four bandwidths are assigned to a lateralization sense alleviating process of the headphone 320, in the DSP 10, according to the configuration of the embodiment.

On the other hand, in the case of the headphone 320, unlike the above-described speaker 318, it is not necessary to consider influence at the mounted part. However, when trying to play the above-described music sound with the headphone 320, there are problems that the sound is localized inside the head and the timbre (the frequency characteristic) changes depending on kind of the headphone 320. The headphone 320 is not influenced by the mounted case unlike the above-described speaker 318. In the configuration of the embodiment, as illustrated in FIG. 3, only three of the seven bandwidths are assigned to its equalizer process, and the remaining four bandwidths are assigned to a process that alleviates the lateralization of the sound inside the head, which will be a significant problem at the headphone 320.

In the embodiment, a process that alleviates the lateralization sense of the headphone 320 is performed by using a head-related transfer function, for this lateralization sense alleviating process. As the lateralization sense alleviating process, a reverb process may be used. Also in the case where the reverb process is performed, the lateralization sense of the sound inside the head when using the headphone 320 will be alleviated.

This headphone adjusting equalizer process program and the lateralization sense alleviating process program are stored in the ROM 304 from the beginning (as later described, since three adjusting equalizer process programs of the above-described speaker adjusting equalizer process programs are remained as the headphone adjusting equalizer process programs, a single program of the headphone adjusting equalizer process is not stored) in practice. Corresponding to the state of the headphone jack 20, the headphone adjusting equalizer process program and the lateralization sense alleviating process program are read by the instruction of the CPU 302 when the headphone 320 is selected as the output side. Among the program storage area at the DSP 10 side, a part of the above-described speaker adjusting equalizer process program storage area will be directly used for a headphone frequency adjustment, and the remaining part will be used for the lateralization sense alleviating process program storage area. These programs will be performed by the arithmetic processing of the DSP 10 to function as the headphone adjusting equalizer, and the lateralization sense alleviating process of the headphone 320 will be also performed.

In the configuration of the embodiment, since the headphone 320 and the speaker 318 are exclusively used, using an identical program area efficiently ensures the alleviation of the lateralization sense when using the headphone 320 and the adjustment of the timbre.

Figure 4:
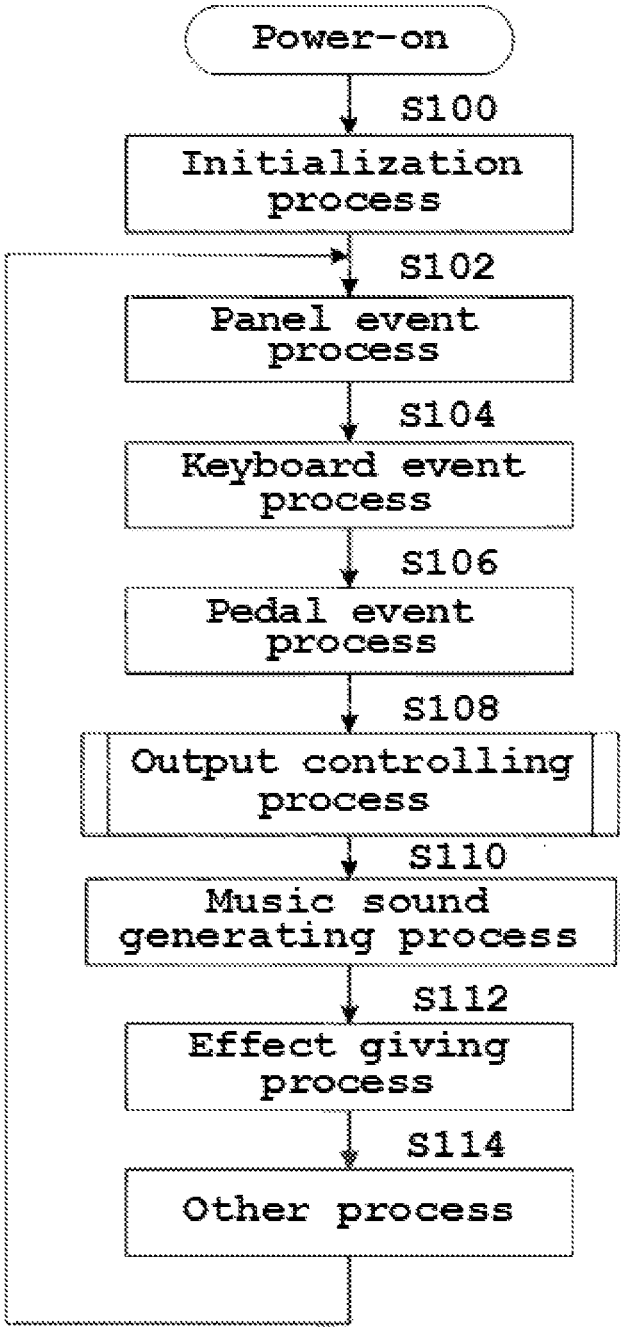

FIG. 4 is a flow chart illustrating an entire process flow performed when this electronic piano is powered on. That is, if being powered on, an initialization process of this electronic piano is performed (Step S100).

Then, a panel event process is performed (Step S102), and subsequently, a keyboard event process (Step S104) and a pedal event process (Step S106) are performed. Then, an output controlling process with the configuration of the embodiment is performed (Step S108), and subsequently, a music sound generating process is performed (Step S110).

Thereafter, an effect giving process of an acoustic effect and the like is performed (Step S112), and other process is performed (Step S114). Then, the flow returns to above-described Step S102 to repeat the above-described processes.

Figure 5:
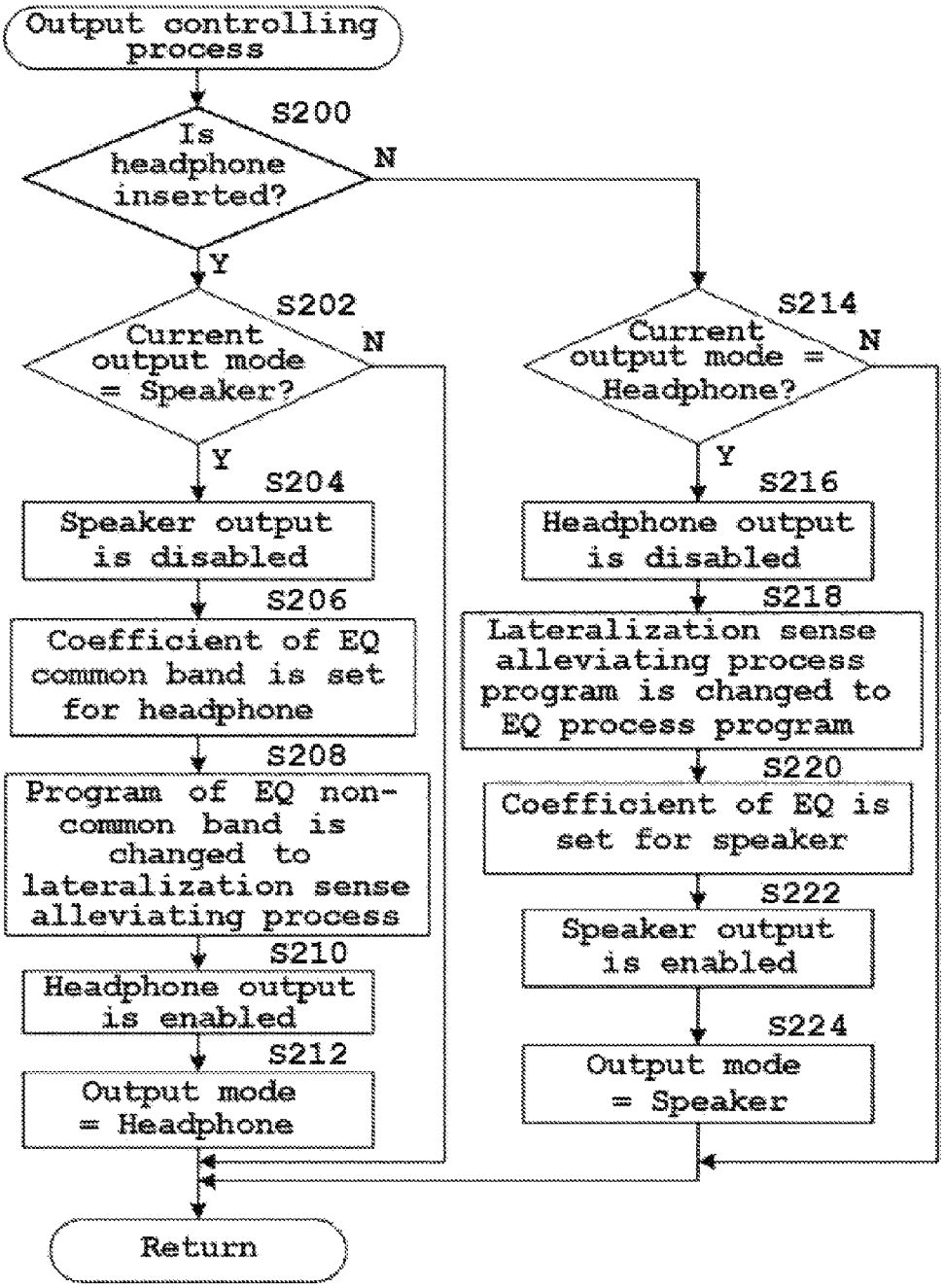
FIG. 5 is a flowchart illustrating a process flow of an output controlling process at Step S108 in FIG. 4.
Figure 6:
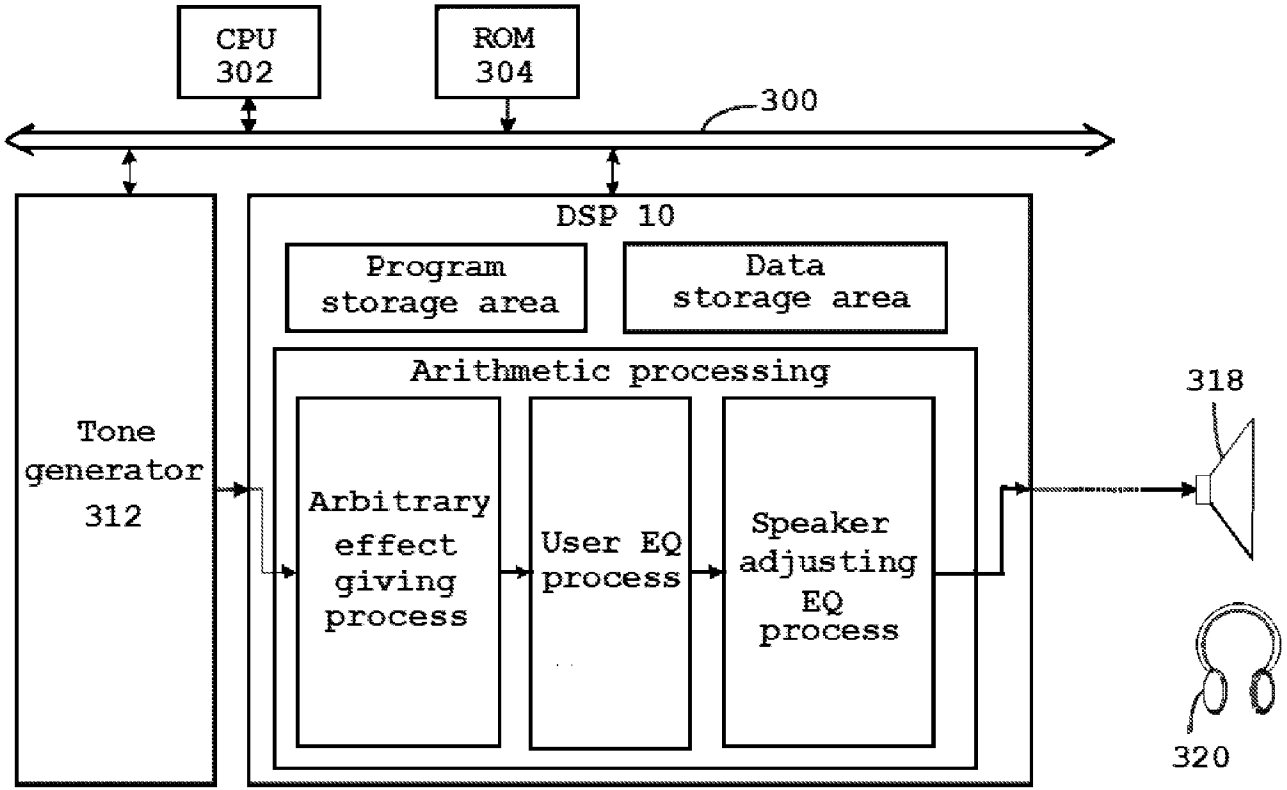
FIG. 6 is a schematic diagram illustrating a conventional configuration in a state where a speaker adjusting equalizer realized by a DSP is disposed.
Figure 7:
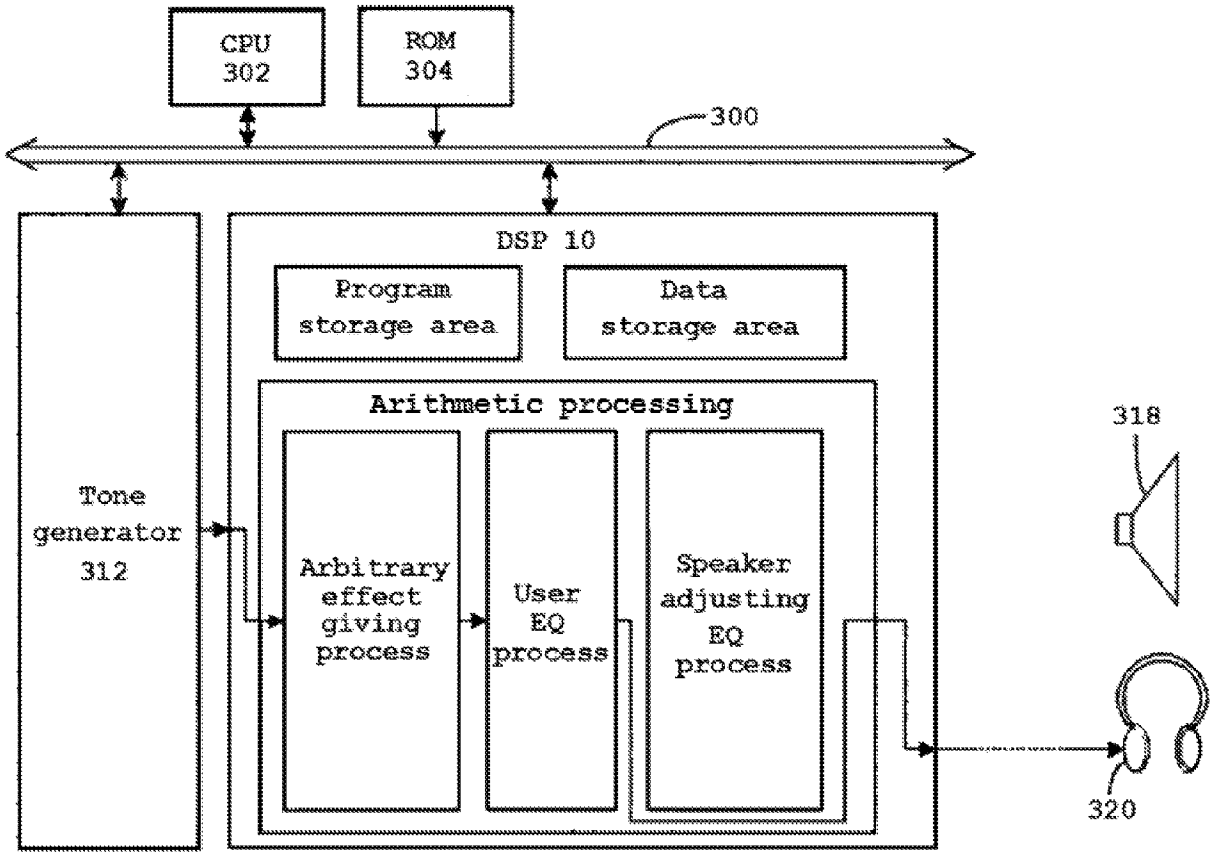
FIG. 7 is a schematic diagram illustrating a state where music sound is output to a side of a headphone without passing through a part of the speaker adjusting equalizer, in the above-described conventional configuration.

FIG. 5 is a flowchart illustrating a process flow of the output controlling process at Step S108 in FIG. 4. As illustrated in this drawing, the above-described headphone jack 20 and the CPU 302 that detects its state (the output selecting means) detect whether or not the headphone plug is inserted into the headphone jack 20 (Step S200), and when the headphone plug is not inserted (Step S200; N), the flow moves to Step S214, which is described later.

On the other hand, when the headphone plug is inserted into the headphone jack 20 (Step S200; Y), the CPU 302 determines whether or not a current output mode is the speaker by checking an output mode flag in a flag area in the RAM 306 (Step S202).

Here, when determining that the current output mode is not the speaker (Step S202; N), this output controlling process (Step S108) is terminated, the flow returns to the music sound generating process (Step S110) in the above-described entire process flow.

Conversely, when determining that the current output mode is the speaker (Step S202; Y), a process disabling the speaker output is performed (Step S204). The speaker adjusting equalizer process programs of the three bands of the above-described seven bands are directly remained as the headphone adjusting equalizer process programs to be used by replacing only the coefficient to that for the headphone. The coefficient for the headphone, which is used in these programs, is read from the ROM 304 by the CPU 302 to be set in a coefficient storage area (not illustrated) of the DSP 10. That is, the coefficient of an equalizer common band of the above-described three bands is set for the headphone (Step S206).

Then, the lateralization sense alleviating process program is read to be changed at program fields of the remaining four bands (program fields of an equalizer non-common band) (Step S208).

Thereafter, the headphone output is enabled (Step S210), and then the output mode flag in the flag area in the RAM 306 is changed to a headphone output mode by the CPU 302 (Step S212). Then, this output controlling process (Step S108) is terminated, and then the flow returns to the music sound generating process (Step S110) in the above-described entire process flow.

On the other hand, in the detection at above-described Step S200, when the headphone plug is not inserted into the headphone jack 20 (Step S200; N), the CPU 302 determines whether or not the current output mode is the headphone by checking the output mode flag in the flag area in the RAM 306 (Step S214).

Here, when determining that the current output mode is not the headphone (Step S214; N), this output controlling process (Step S108) is terminated, and then the flow returns to the music sound generating process (Step S110) in the above-described entire process flow.

Conversely, when determining that the current output mode is the headphone (Step S214; Y), a process disabling the headphone output is performed (Step S216). The lateralization sense alleviating process programs of the above-described four bands (the equalizer non-common bands) are changed to the original speaker adjusting equalizer process programs (Step S218). The coefficient used for the equalizer process program of the total seven bands (the coefficient used for the speaker adjusting equalizer) is read from the ROM 304 to the CPU 302 to be set to the coefficient storage area (not illustrated) of the DSP 10 (Step S220).

Then, the speaker output is enabled (Step S222), and then the output mode flag in the flag area in the RAM 306 is changed to the speaker output mode by the CPU 302 (Step S224). Then, this output controlling process (Step S108) is terminated, and then the flow returns to the music sound generating process (Step S110) in the above-described entire process flow.

According to the configuration of the embodiment described in detail above, the above-described signal processing means perform the (speaker adjusting) equalizer process that processes the entire bandwidth with the seven bands. When the above-described output selecting means select the headphone, the above-described signal processing means perform the (headphone adjusting) equalizer process of the entire bandwidth with the three bands of the equalizer process, and process the characteristic changing process of other bands by replacing it to the lateralization sense alleviating process for the headphone. Since the headphone 320 and the speaker 318 are exclusively used, using an identical program storage area efficiently ensures the alleviation of the lateralization sense when using the headphone 320 and the adjustment of the timbre.

The lateralization sense alleviating process for the headphone in the configuration of the embodiment is one of the headphone sound fields controlling process. The headphone sound field controlling process is not limited to the lateralization sense alleviating process. Other process appropriate for the sound field control when using the headphone may be used.

The effects giving device of the present invention is not limited to only the above-described exemplary drawings. It is obvious that various changes can be applied in a range without departing from the gist of the present invention.

INDUSTRIAL APPLICABILITY

The effects giving device of the present invention is not limited to the acoustic effect addition by the DSP and the like. Insofar as a configuration that can perform a corresponding effect addition, the effects giving device of the present invention can be used for various kinds of things.

REFERENCE SIGNS LIST

10 DSP
20 headphone jack
300 system bus
302 CPU
304 ROM
306 RAM
308 operation panel
308*a* panel scan circuit
310 keyboard
310*a* keyboard scan circuit
312 tone generator
312*a* waveform memory
314 D/A converter
316 amplifier
318 speaker
320 headphone

The invention claimed is:

1. An electronic musical keyboard using a programmable processor, comprising:

a signal processing unit configured to give an effect to an input music signal;

a unit configured to output the signal to any of a plurality of outputting units at least including a headphone, the signal processing unit having given the effect to the signal; and an output selecting unit configured to select any of the plurality of outputting units to output;

wherein the signal processing unit performs a characteristic changing process that processes an entire bandwidth with N bands when outputting to one of the plurality of outputs that is not the headphone, and when the headphone is selected by the output selecting unit, the signal processing unit performs the characteristic changing process of the entire bandwidth with M bands (M<N) of the characteristic changing process, and the characteristic changing process is done by using a headphone sound field controlling process.

2. The electronic musical keyboard according to claim 1, wherein the characteristic changing process is an equalizer process.

3. The electronic musical keyboard according to claim 1, wherein the headphone sound field controlling process is a lateralization sense alleviating process.

4. The electronic musical keyboard according to claim 2, wherein the headphone sound field controlling process is a lateralization sense alleviating process.

5. The electronic musical keyboard according to claim 3, wherein as the lateralization sense alleviating process, a head-related transfer function is used to perform a process that alleviates a lateralization sense of the headphone.

6. The electronic musical keyboard according to claim 4, wherein as the lateralization sense alleviating process, a head-related transfer function is used to perform a process that alleviates a lateralization sense of the headphone.

7. The electronic musical keyboard according to claim 3, wherein as the lateralization sense alleviating process, a reverb process is performed.

8. The electronic musical keyboard according to claim 4, wherein as the lateralization sense alleviating process, a reverb process is performed.

* * * * *